US009719198B2

(12) United States Patent
Ikenaka

(10) Patent No.: US 9,719,198 B2
(45) Date of Patent: Aug. 1, 2017

(54) FOOTWEAR AND METHOD FOR KNITTING FOOTWEAR

(71) Applicant: Shima Seiki Mfg., Ltd., Wakayama-shi, Wakayama (JP)

(72) Inventor: Masamitsu Ikenaka, Wakayama (JP)

(73) Assignee: Shima Seiki Mfg., Ltd., Wakayama-shi, Wakayama (JP)

( * ) Notice: Subject to any disclaimer, the term of this patent is extended or adjusted under 35 U.S.C. 154(b) by 291 days.

(21) Appl. No.: 14/423,456

(22) PCT Filed: Jul. 26, 2013

(86) PCT No.: PCT/JP2013/070284

§ 371 (c)(1),
(2) Date: Feb. 24, 2015

(87) PCT Pub. No.: WO2014/050289

PCT Pub. Date: Apr. 3, 2014

(65) Prior Publication Data

US 2016/0198797 A1 Jul. 14, 2016

(30) Foreign Application Priority Data

Sep. 25, 2012 (JP) ..... 2012-211377

(51) Int. Cl.
*D04B 1/22* (2006.01)
*A43B 23/02* (2006.01)
(Continued)

(52) U.S. Cl.
CPC ..... *D04B 1/22* (2013.01); *A43B 1/04* (2013.01); *A43B 23/0205* (2013.01);
(Continued)

(58) Field of Classification Search
CPC ..... D04B 1/106; D04B 1/22; D04B 1/108; D04B 1/26; A43B 23/0205; A43B 1/04; A43B 23/0245
(Continued)

(56) References Cited

U.S. PATENT DOCUMENTS 271,338 A * 1/1883 Lasher ..... D04B 1/26 66/187
1,216,374 A * 2/1917 Smith ..... D04B 1/26 66/187
(Continued)

FOREIGN PATENT DOCUMENTS

DE 297 00 546 U1 6/1997
EP 2 116 642 A1 11/2009
(Continued)

OTHER PUBLICATIONS

Extended European Search Report cited in European Application No. 13842509.5 dated May 3, 2016, 10 pages.
(Continued)

*Primary Examiner* — Danny Worrell
(74) *Attorney, Agent, or Firm* — Rothwell, Figg, Ernst & Manbeck, P.C.

(57) ABSTRACT

There is provided a footwear having a three-dimensional shape that fits a foot of a wearer regardless of a stretchability of a knitted fabric. A seamless footwear (1) including an instep cover section (3) and a sole cover section (2) is provided. The sole cover section (2) is divided to a heel portion (20) and a sole main body portion (21). A setup portion (1S) or a knitting end portion is formed at a heel side end of the footwear (1), and such setup portion (1S) or the knitting end portion is extended in a height direction of the footwear (1) and also connected to the heel portion (20). The heel portion (20) is formed by a knitting of stacking a stitch row for plural tiers in a wale direction, and gradually differing the number of stitches in a knitting width direction of the stitch row when stacking tiers of the stitch row. The heel portion (20) is formed to a tongue shape in which a width gradually becomes narrower toward a heel side of the footwear (1) according to the change in the number of stitches.

6 Claims, 7 Drawing Sheets

(51) Int. Cl.
*D04B 1/10* (2006.01)
*A43B 1/04* (2006.01)
*D04B 1/26* (2006.01)

(52) U.S. Cl.
CPC ..... *A43B 23/0245* (2013.01); *D04B 1/106* (2013.01); *D04B 1/108* (2013.01); *D04B 1/26* (2013.01); *D10B 2403/0332* (2013.01); *D10B 2501/043* (2013.01)

(58) Field of Classification Search
USPC ..... 66/184, 186, 187
See application file for complete search history.

(56) References Cited

U.S. PATENT DOCUMENTS 2,244,604 A * 6/1941 Bell ..... A61F 13/08 66/187
2,301,468 A * 11/1942 Smetana ..... D04B 1/26 66/182
2,319,768 A * 5/1943 Beers ..... D04B 1/26 66/169 R
3,320,774 A * 5/1967 Billi ..... D04B 1/26 66/182
5,170,646 A * 12/1992 Gariboldi ..... D04B 1/108 66/172 R
5,737,943 A 4/1998 Bernhardt
7,263,860 B2 * 9/2007 Okuno ..... D04B 1/18 66/64
8,434,331 B2 * 5/2013 Funaki ..... D04B 1/108 66/174

FOREIGN PATENT DOCUMENTS

EP 2 199 444 A1 6/2010
JP 3047506 U 4/1998
JP 2003-342803 A 12/2003
JP 2006-291439 A 10/2006

OTHER PUBLICATIONS

International Search Report cited in PCT/JP2013/070284 dated Oct. 15, 2013.

* cited by examiner (C)

FOOTWEAR AND METHOD FOR KNITTING FOOTWEAR

CROSS REFERENCE TO RELATED APPLICATION

This application is a 35 U.S.C. 371 National Phase Entry Application from PCT/JP2013/070284, filed Jul. 26, 2013, which claims the benefit of Japanese Patent Application No. JP2012-211377 filed on Sep. 25, 2012, the disclosure of which is incorporated herein in its entirety by reference.

TECHNICAL FIELD

The present invention relates to a footwear and a method for knitting the footwear.

BACKGROUND ART

A footwear such as shoes, socks, and the like is knitted using a flat knitting machine. For example, in the socks, a sole cover section that covers a sole of a wearer; an instep cover section that covers an instep side portion of the wearer; and a body section that is connected to the instep cover section and covers a portion on the upper side from a vicinity of an ankle of the wearer are conventionally knitted integrally in a seamless manner. In the knitting of the socks, the knitting width of the socks is widened at the portion corresponding to a heel in order to make the socks lie along the shape of the foot, in particular, the shape of the heel of the wearer (see e.g., Patent Document 1).

PRIOR ART DOCUMENT

Patent Document

[Patent Document 1] Japanese Laid-Open Patent Publication No. 2006-291439

SUMMARY OF THE INVENTION

Problems to be Solved by the Invention

However, the footwear comprising a conventional knitting pattern is hardly in a three-dimensional shape that lies along the shape of the foot.

Although the portion corresponding to the heel is bulged out, the conventional footwear is planar as a whole. Thus, when wearing such footwear, the footwear is fitted to the foot by the stretchability of the knitted fabric, but the stitches may be locally stretched or tense at the portion corresponding to the heel in the footwear. The appearance of the footwear when it is worn thus may be impaired, or the wearer may feel a certain type of stress. Moreover, when wearing the footwear knitted with a thermoplastic yarn having a poor stretchability and the like, the knitted fabric may become loose at the portion corresponding to the heel of the footwear.

The present invention is made in light of the foregoing, and an object of the present invention is to provide a footwear having a three-dimensional shape that fits the foot of the wearer regardless of the stretchability of the knitted fabric, and a method for knitting such footwear.

Means for Solving the Problems

According to an aspect of the present invention, a footwear includes an instep cover section that covers an instep side portion of a wearer, and a sole cover section that covers a sole of the wearer. In such footwear, the instep cover section and the sole cover section are integrally knitted in a seamless manner with a knitting pattern, by setting out from a position of a heel side end of the footwear and ending the knitting at a position other than the heel side end, or by setting out from a position other than the heel side end and ending the knitting at a position of the heel side end. The footwear comprises the configurations [1], [2] below, when a portion corresponding to a region of a predetermined range from a back end of a heel of the wearer is assumed as a heel portion and the other portion is assumed as a sole main body portion in the sole cover section of the footwear.

[1] A setup portion or a knitting end portion formed at the heel side end is extended in a height direction of the footwear and also connected to the heel portion.

[2] The heel portion is formed by a knitting of stacking a stitch row in plural tiers in a wale direction and gradually differing the number of stitches in a knitting width direction of the stitch row when stacking the tiers of the stitch row, and the heel portion is formed to a tongue shape in which a width gradually becomes narrower toward a heel side of the footwear according to the change in the number of stitches.

The predetermined range from the back end of the heel is a range of about a half of the length from the back end to the arch, and specifically, 2 to 6 cm from the back end and more preferably, 3 to 5 cm from the back end.

According to one aspect (hereinafter referred to as first aspect) of the footwear of the present invention, the setup portion or the knitting end portion formed at the heel side end of the footwear is arranged from an upper end to a lower end of the instep cover section and extended to the sole cover section up to a boundary of the heel portion and the sole main body portion; and the heel portion is formed by a plurality of fan-shaped pieces lined in an arc shape with the setup portion or the knitting end portion in the sole cover section in between. The heel portion is formed to a tongue shape as the fan-shaped pieces are lined in the arc shape.

According to another aspect (hereinafter referred to as second aspect) of the footwear of the present invention, the setup portion or the knitting end portion formed at the heel side end of the footwear is arranged from an upper end to a lower end of the instep cover section (i.e., the setup portion or the knitting end portion is not formed in the sole cover section). In this case, the whole of the heel portion is formed by a flechage knitting of gradually widening a knitting width, or by a flechage knitting of gradually narrowing the knitting width each time the number of tiers in a wale direction of the stitch row configuring the heel portion is increased, so that the heel portion is formed to a tongue shape.

According to another aspect (hereinafter referred to as third aspect) of the footwear, the setup portion or the knitting end portion formed at the heel side end of the footwear is arranged from an upper end to a lower end of the instep cover section and extended to the sole cover section up to a boundary of the heel portion and the sole main body portion; and the heel portion is formed by a plurality of fan-shaped pieces lined in an arc shape with the setup portion or the knitting end portion in the sole cover section in between and an interposing piece arranged between the adjacent fan-shaped pieces. The heel portion is formed to a tongue shape as the fan-shaped pieces are lined in the arc shape.

According to another aspect of the footwear of the present invention, the footwear is a shoe upper knitted using a thermoplastic yarn.

According to an aspect of the present invention, a method for knitting a footwear knits a footwear including an instep cover section that covers an instep side portion of a wearer and a sole cover section that covers a sole of the wearer. In the method for knitting the footwear according to the present invention, a region of a predetermined range from a back end of a heel of the wearer is assumed as a heel portion and the other portion is assumed as a sole main body portion, in the sole cover section, and the footwear is knitted according to following procedure [1] or [2] using a flat knitting machine including at least a pair of a front and a back needle bed and in which stitches formed on each needle bed are transferrable. In the knitting of the heel portion, a knitting of differing the number of stitches in a knitting width direction of a stitch row of each tier when stacking the stitch row in plural tiers in a wale direction is carried out.

[1] A setup portion is knitted, and a heel side portion of a left side surface and a right side surface of the instep cover section and a heel portion of the sole cover section are knitted based on the setup portion. Next, a sole main body portion of the sole cover section and a toe side portion of the instep cover section are knitted to complete the footwear.

[2] A setup portion is knitted, and a toe side portion of the instep cover section and the sole main body portion are knitted based on the setup portion. Next, a heel portion of the sole cover section and a heel side portion of the instep cover section are knitted toward the heel side of the footwear, and a left side surface and a right side surface of the footwear are closed at a heel side end of the footwear to complete the footwear.

Effects of the Invention

The footwear of the present invention is a footwear produced with the method for knitting the footwear according to the present invention, and has a three-dimensional shape that better lies along the shape of a foot, especially, the shape of the heel of the wearer as compared to the conventional footwear. Thus, when the footwear of the present invention is worn, the footwear fits the foot of the wearer regardless of the stretchability of the knitted fabric, and drawbacks such as the stitches being locally stretched or tense at the heel portion of the footwear are less likely to occur. The footwear of the present invention has a three-dimensional shape because the heel portion is formed in the sole cover section of the footwear, and the shape of the heel portion is a tongue shape curved along the contour shape of the sole of the wearer.

In the footwear of the present invention, the heel portion may be any of the first aspect, the second aspect, or the third aspect described above, but in particular, is preferably of the first aspect. This is because in the first aspect, the boundary portion of the heel portion and the instep cover section is smooth and the knitting of the heel portion is also easy.

The shoe upper (footwear) knitted using the thermoplastic yarn, on the other hand, is less likely to lose shape, and excels in foot comfort.

DETAILED DESCRIPTION OF THE PREFERRED EMBODIMENTS

Hereinafter, an embodiment of a footwear and a method for knitting the footwear of the present invention will be described based on the figures. A two-bed flat knitting machine including at least a pair of a front and a back needle bed and in which stitches can be transferred between the front and back needle beds is used to manufacture the footwear. The flat knitting machine to be used is not, of course, limited to the two-bed flat knitting machine, and may be a four-bed flat knitting machine, for example.

First Embodiment

<<Shoe Upper>>

Figure 1:
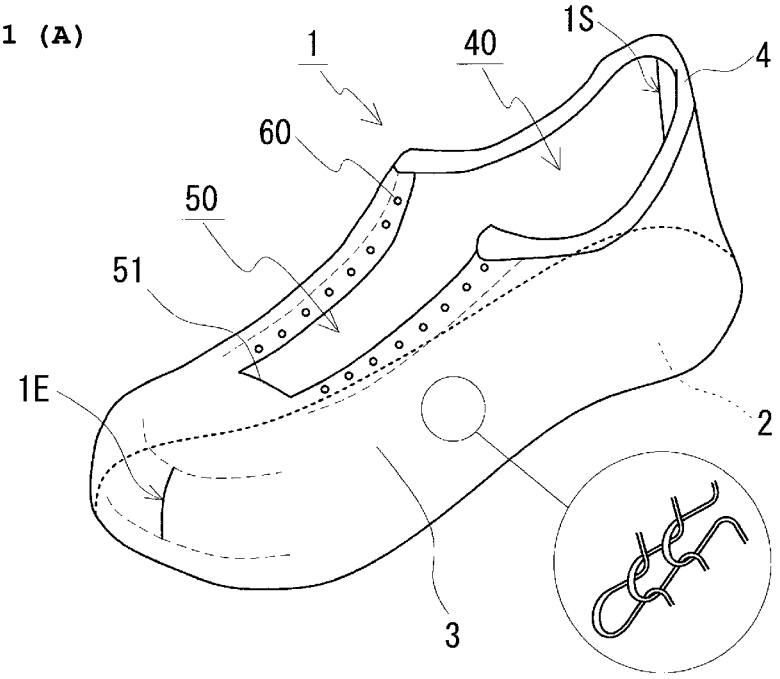
FIG. 1(A) is a schematic top perspective view of a footwear shown in a first embodiment.
FIG. 1(B) is a schematic bottom perspective view of the footwear.
Figure 1:
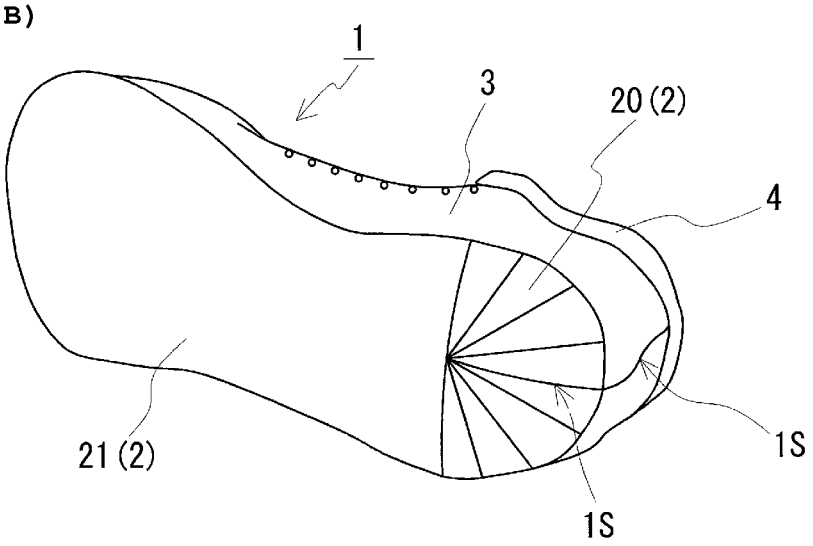

A shoe upper (footwear) 1 of the present embodiment shown in FIG. 1 comprises a knitting pattern obtained by integrally knitting, in a seamless manner, an instep cover section 3 and a sole cover section 2 according to a special knitting procedure. It is apparent that the shoe upper 1 is knitted through the special knitting procedure since a substantially semi-circular heel portion 20 is formed in a region of a predetermined range on a heel side of the sole cover section 2, as will be described later. The knitting pattern configuring the shoe upper 1 is not particularly limited, and for example, may be a plain stitch pattern, a mesh pattern, a rib pattern, or a mixed pattern thereof.

In the shoe upper 1 of the present embodiment, a portion excluding an insert section 4, to be described later, is produced by starting the knitting from a heel side end and ending the knitting at a toe side end. A setup portion 1S, which is a portion to start the knitting, is extended in a height direction of the shoe upper 1 at the heel side end of the shoe upper 1, as shown in FIG. 1(B). More specifically, the setup portion 1S is arranged from an upper end to a lower end of the instep cover section 3 and extended to the sole cover section 2 up to a boundary of a heel portion 20 and a sole main body portion 21. A knitting end portion 1E, which is a portion to end the knitting, is extended in the height direction of the shoe upper 1 at the toe side end of the instep cover section 3 in the shoe upper 1, as shown in FIG. 1(A). The knitting of the shoe upper 1 is advanced from the heel side toward the toe side by setting the setup portion 1S and the knitting end portion 1E in the position and direction described above, and the stitches at the portion excluding the heel portion 20 and the insert section 4, to be described later, are aligned in a direction in a length (forward) direction of the shoe upper 1 (see circled enlarged view of FIG. 1(A)). An overall appearance of the shoe upper 1 is improved by aligning the direction of the stitches.

The heel portion 20 of the shoe upper 1 shown in FIG. 1(B) is formed by the knitting of differing the number of stitches in the knitting width direction of a stitch row of each tier when stacking the stitch row in plural tiers in a wale direction. Thus, the heel portion 20 becomes a tongue piece shape (substantially semicircular shape) in which a width gradually narrows toward the heel side of the shoe upper 1 by differing the number of stitches in the knitting width direction of the stitch row of each tier, and consequently, the shoe upper 1 becomes a three-dimensional shape that lies along the curve of the heel of the wearer. In the present embodiment, the heel portion 20 is configured by a plurality of fan-shaped pieces lined in an arc shape with the setup portion 1S in the heel portion 20 in between. The knitting procedure of the heel portion 20 will be described later.

In addition, the instep cover section 3 of the shoe upper 1 in the present embodiment is formed with a slit 50 that extends from an insert opening 40 toward the toe, so that the foot can be easily inserted from the insert opening 40. An eyelet hole 60 for attaching eyelets, through which a shoelace is passed, is formed at positions sandwiching the slit 50 in the instep cover section 3.

Furthermore, the insert section 4 is arranged at an edge in the vicinity of the insert opening 40, that is, an upper end edge of the instep cover section 3, of the shoe upper 1 of the present embodiment to reinforce the edge. Although the insert section 4 is not essential, a contour shape of the edge of the instep cover section 3 in the vicinity of the insert opening 40 can be stabilized by arranging the insert section 4, and consequently, the shoe upper 1 in which the foot can be easily inserted from the insert opening 40 can be obtained. The insert section 4 in the present embodiment is formed with a knitting pattern connected, in a seamless manner, to the instep cover section 3, where the direction of the stitches of the insert section 4 is the height (downward) direction of the shoe upper 1 reflecting the knitting steps, to be described later. The insert section 4 may be attached afterwards to the shoe upper 1 without the insert section 4. For example, a reinforcement material including a resin, and the like may be attached to the edge of the insert opening 40 of the shoe upper 1 without the insert section 4, or the insert section 4 may be formed by joining a knitting pattern knitted separate from the shoe upper 1 to the edge.

<<Knitting Procedure>>

The shoe upper 1 described above can be produced by knitting a right side portion of the shoe upper 1 with one needle bed of the flat knitting machine and knitting a left side portion with another needle bed, using a knitting yarn including a thermoplastic resin and the like. FIG. 2(A) is a knitting image diagram schematically showing a knitting procedure of the right side portion of the shoe upper 1, and FIG. 2(B) is a partial bottom enlarged view of the sole cover section 2 knitted according to the knitting image diagram. The left side portion of the shoe upper 1 in FIG. 2(A) can be assumed as being arranged on a far side in the plane of drawing, and the right side portion and the left side portion of the shoe upper 1 are connected at the right side in the plane of drawing. The left side portion of the shoe upper 1 is knitted through the knitting similar to the right side portion, and hence the description thereof will be omitted. Needless to say, the shape of the foot is left-right asymmetric, and hence the knitting width, and the like of the right side portion and the left side portion of the shoe upper 1 are preferably changed in accordance with the shape of the foot.

Figure 2:
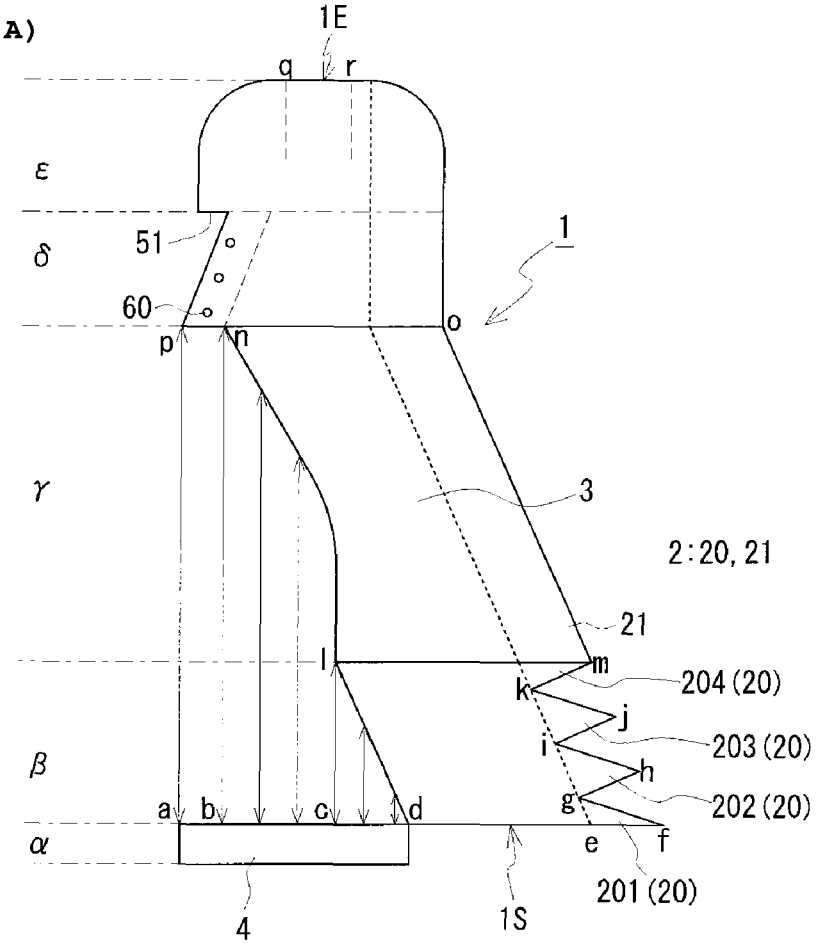
FIG. 2(A) is a knitting step image diagram schematically showing knitting steps of the footwear of the first embodiment.
FIG. 2(B) is a partial bottom enlarged view of the footwear knitted according to the knitting step image of FIG. 2(A)
Figure 2:
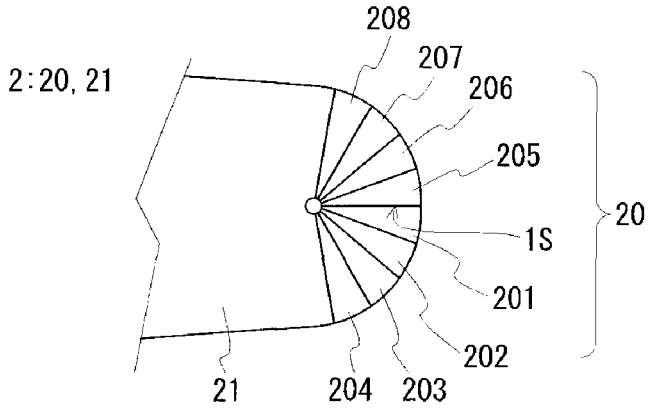

In FIG. 2(A), the knitting is advanced from the lower side toward the upper side. The shoe upper 1 according to the present embodiment is knitted by being divided into five regions of an insert section region α; a heel region δ, a main body back part region γ, a main body front part region δ, and a toe region ϵ. A dotted line of FIG. 2(A) represents the boundary of the instep cover section 3 and the sole cover section 2; a dash line (also shown in FIG. 1(A)) represents a portion where narrowing stitches are carried out; and a chain dash line represents the boundaries of the regions α to ϵ; where lower case alphabets a to r are denoted to the key points in the knitting in FIG. 2.

[Knitting of Insert Section Region α]

In the knitting shown in FIG. 2, C-shaped knitting having the right side as a turn-back position is first carried out to knit the insert section 4. That is, the insert sections 4 held front and back are not connected at the position on the left side in the plane of drawing, and a slit 50 (see FIG. 1(A)) is formed at such unconnected portion. At this time point, the stitches of the a-b-c-d of the insert section 4 are held on the needle bed.

[Knitting of Heel Region β]

The setup portion 1S is then formed on a knitting needle on which the stitch of the insert section 4 is not held (see d-e-f). As shown in FIG. 1(B), the setup portion 1S is arranged from the upper end to the lower end of the instep cover section 3, and extended to the position of the heel cover section 2. As described above with reference to FIG. 1(B), the end on the heel cover section 2 side of the setup portion 1S is extended up to the boundary of the heel portion 20 and the sole main body portion 21 in the heel cover section 2. In other words, the position of the end of the setup portion 1S determines the size of the heel portion 20.

After the setup portion 1S is formed, a stitch row of plural tiers is knitted following a wale direction of the setup portion 1S. In this case, flechage knitting of gradually reducing the number of stitches in a knitting width direction is carried out at the position on the right side in the plane of drawing to knit a part of the instep cover section 3 and a fan-shaped piece 201. Furthermore, in the present embodiment, the stitch row is transferred toward a side of the insert section 4 (left side) each time the stitch row is knitted for one to three tiers by the flechage knitting, and the stitches on the insert section 4 side (left side) of the stitch row and the stitches on the instep cover section 3 side (right side) of the insert section 4 are joined. The right side portion of the shoe upper 1 illustrated and the left side portion of the shoe upper 1 (not shown) are joined at the position denoted with the reference number f in the figure.

Moreover, the flechage knitting of gradually increasing the number of stitches in the knitting width direction is carried out at the position on the right side in the plane of drawing, and thereafter, the flechage knitting of gradually reducing the number of stitches in the knitting width direction is carried out, where such knitting is repeated two times to knit a part of the instep cover section 3 and fan-shaped pieces 202, 203. In this case, the g-h of the fan-shaped piece 202 is knitted in continuation to the wale direction of the g-f of the fan-shaped piece 201 to join the fan-shaped piece 201 and the fan-shaped piece 202; and the i-j of the fan-shaped piece 203 is knitted in continuation to the wale direction of the i-h of the fan-shaped piece 202 to join the fan-shaped piece 202 and the fan-shaped piece 203. The stitch row knitted by the flechage knitting is transferred to the side of the insert section 4 (left side), and a part of the d-l line of the instep cover section 3 is joined to the insert section 4.

Lastly, the flechage knitting of gradually increasing the number of stitches in the knitting width direction is carried out at the position on the right side in the plane of drawing to knit a part of the instep cover section 3 and a fan-shaped piece 204. In this case, the k-m of the fan-shaped piece 204 is knitted in continuation to the wale direction of the k-j of the fan-shaped piece 203 to join the fan-shaped piece 203 and the fan-shaped piece 204.

At the time point the knitting of the fan-shaped piece 204 is finished, the reference numerals f, h, j, m are connected to become one portion, and the fan-shaped pieces 201 to 204 are lined in an arc shape with the connected portion as a center. Since similar knitting is also carried out on the left side portion of the shoe upper 1 (not shown in FIG. 2(A)), the heel portion 20 comprising the fan-shaped pieces 201 to 204, 205 to 208 lined in the arc shape with the setup portion 1S in between is formed, as shown in FIG. 2(B), at the time point the knitting of the fan-shaped piece 204 is finished. The fan-shaped pieces 205 to 208 are the knitted fabric of the left side portion of the shoe upper 1 knitted on a far side in the plane of drawing in FIG. 2(A), and is the knitted fabric knitted according to the procedure similar to the fan-shaped pieces 201 to 204. The fan-shaped pieces 201 to 208 are lined in the arc shape with the base of the fan being directed toward the toe side (left side in FIG. 2(B)) with the portion shown by a white circle (i.e., portion where the reference numerals f, h, j, m of FIG. 2(A) are connected to one portion) as the center, and a substantially circular arc portion on an outer side of the fan-shaped pieces 201 to 208 forms the curved shape of the heel portion 20.

At the time point the knitting of the heel region β is finished, the stitches of the a-b-c(l)-m are held on the needle bed.

[Knitting of Main Body Back Part Region γ]

Then, the knitting of the stitch row to become the instep cover section 3 and the sole cover section 2 following the wale direction of the stitches of the l-m by the C-shaped knitting, and the transferring of the knitted stitch row toward the side of the insert section 4 (left side) to overlap it with the stitches of the c-b of the insert section 4 are repeated. According to such knitting, the l-n of the instep cover section 3 is joined to the c-b of the insert section 4, and the direction of the stitches of the instep cover section 3 is directed in the length (forward) direction of the shoe upper 1.

In the present embodiment, when increasing the number of tiers of the stitch row configuring the main body back part region γ of the instep cover section 3, the knitting width of the stitch row is reduced and then the knitting width of the stitch row is increased. Accordingly, as shown in FIG. 1, the portion corresponding to the ankle of the wearer in the insert section 4 is curved toward the sole cover section so as to avoid the ankle (see also l-n of FIG. 2). The curved shape is formed by increasing and decreasing the number of stitches in the knitting width direction of the instep cover section 3 at the position (position of l-n of FIG. 2) on the insert opening side. Thus, the stitches configuring the instep cover section 3 are lined straight toward the toe portion. If the stitches are increased and decreased within a knitting width of the instep cover section 3, the direction of the stitches may become misaligned and the appearance of the shoe upper 1 may be impaired.

The increase and decrease of the stitches in the main body back part region γ are preferably differed between the right side portion and the left side portion of the shoe upper 1 (similarly in the main body front part region δ and the toe region ϵ to be described later). For example, the shapes of the right side portion and the left side portion are changed in view of the three-dimensional shape of the foot by making the height of the portion on the first toe side in the shoe upper 1 higher than the portion on the fifth finger side, and the like. In this case, the increase and decrease of the stitches are preferably carried out at the instep side portion of the instep cover section 3 and the position of the sole cover section 2. The direction of the stitches at the side surface of the shoe upper 1 thus can be aligned, and a satisfactory appearance of the shoe upper 1 can be obtained.

[Main Body Front Part Region δ]

Next, a stitch row to become the main body front part region δ of the instep cover section 3 is knitted for plural tiers following the wale direction of the stitches of the a-b(n)-o. In this case, the knitting width of the stitch row is reduced at the position of the dash line toward the toe region ϵ, so that the main body front part region δ can be formed to a tapered shape that lies along the shape of the foot.

Furthermore, in the present embodiment, the eyelet holes 60 are formed at the position in the vicinity of the slit 50 (see FIG. 1) when knitting the main body front part region δ. The eyelet hole 60 can be formed through the known mesh knitting, miss knitting, and the like.

[Knitting of Toe Region ϵ]

Upon knitting the toe region ϵ, the portion to become a cut end 51 of the slit 50 (see FIG. 1) is first set up through the C-shaped knitting. Next, tubular knitting is carried out in continuation to the wale direction of the stitch row of the terminating end in the wale direction of the main body front part region δ and the stitch row of the portion to become the cut end 51 to knit the toe region ϵ. In this case, narrowing stitches are carried out at the position on the instep side and the position on the sole cover section 2 side of the instep cover section 3 shown with a dash line (see also dash line of FIG. 1) to reduce the knitting width, and lastly, the left side portion and the right side portion of the shoe upper 1 are closed at the position of the q-r at the distal end. Thus, as shown in FIG. 1, the distal end of the shoe upper 1 can be formed to a tapered shape that lies along the shape of the foot. The knitting end portion 1E formed by closing the left side portion and the right side portion of the shoe upper 1 is extended in the height direction of the shoe upper 1 as shown in FIG. 1(A).

After the knitting of the shoe upper 1 shown in FIG. 1 is finished, a tongue (not shown) is attached to the inner side of the slit 50 of the instep cover section 3 and the outer sole (not shown) is joined to the sole cover section 2. The eyelets (not shown) are attached to the eyelet holes 60. The entire shoe upper 1 is fitted to a foot type and subjected to thermal treatment to three-dimensionally mold the shoe upper 1. Lastly, a shoelace is passed through the eyelets to complete the shoe.

The tongue can also be integrally formed with the shoe upper 1 by the flat knitting machine. In this case, a setup portion is knitted when knitting the vicinity of the cut end 51, and the tongue is knitted following such setup portion. Furthermore, when producing shoes to be used indoors, the outer sole does not need to be attached to the shoe upper 1. In this case, the sole cover section may have a thick knitting pattern.

As described above, the shoe upper 1 of the present embodiment has a three-dimensional shape that lies along the shape of the foot of the wearer regardless of the stretchability of the knitted fabric. This is because the heel portion 20 having a circular arc line along the contour shape of the sole of the wearer is formed at the portion on the heel side of the sole cover section 2, as shown in FIG. 1(B). With the three-dimensional shoe upper 1 of the present embodiment that already lies along the shape of the foot at the time point the knitting is finished, the heel portion of the shoe upper 1 does not become baggy or the lining of the stitches is less likely to be disturbed in the vicinity of the heel portion when performing thermal treatment to mold the shoe upper 1, whereby a satisfactory appearance of the shoe upper 1 is obtained.

Furthermore, in the shoe upper 1 of the present embodiment, the direction of the stitches in the instep cover section 3 is directed and aligned toward the toe side (see circled portion in FIG. 1(A)), and hence a satisfactory appearance is obtained. This is because the setup portion 1S extending in the height direction of the shoe upper 1 is formed on the heel side of the shoe upper 1, the right side portion and the left side portion of the shoe upper 1 are knitted from such setup portion 1S, and the right side portion and the left side portion of the shoe upper 1 are closed on the toe side of the shoe upper 1. Furthermore, in the shoe upper 1, the vicinity of the heel portion 20 is less likely to become baggy and the disturbance of the stitches is small, whereby the appearance of the heel portion of the shoe upper 1 is also satisfactory.

The shoe upper 1 of the present embodiment is obtained by integrally knitting, in a seamless manner, the instep cover section 3 and the sole cover section 2, and hence excels in productivity. When connecting the outer sole to the shoe upper 1, the shoe upper 1 formed with the knitted fabric is already held in a three-dimensional shape, and hence the alignment of the shoe upper 1 and the outer sole cover section is facilitated and the shoe upper 1 is less likely to lose shape, whereby the connecting task itself is also facilitated.

Second Embodiment

Figure 3:
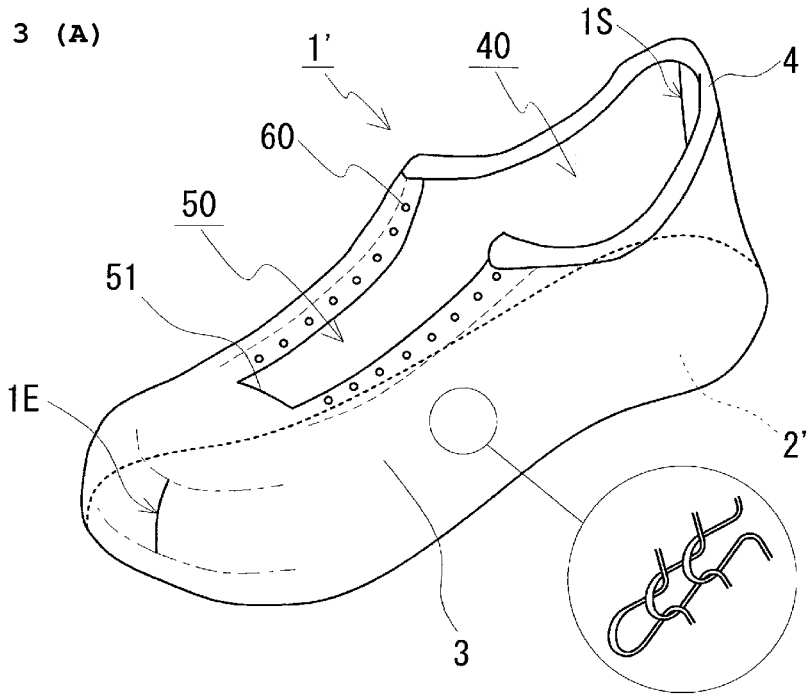
FIG. 3(A) is a schematic top perspective view of a footwear shown in a second embodiment.
FIG. 3(B) is a schematic bottom perspective view of the footwear.
Figure 3:
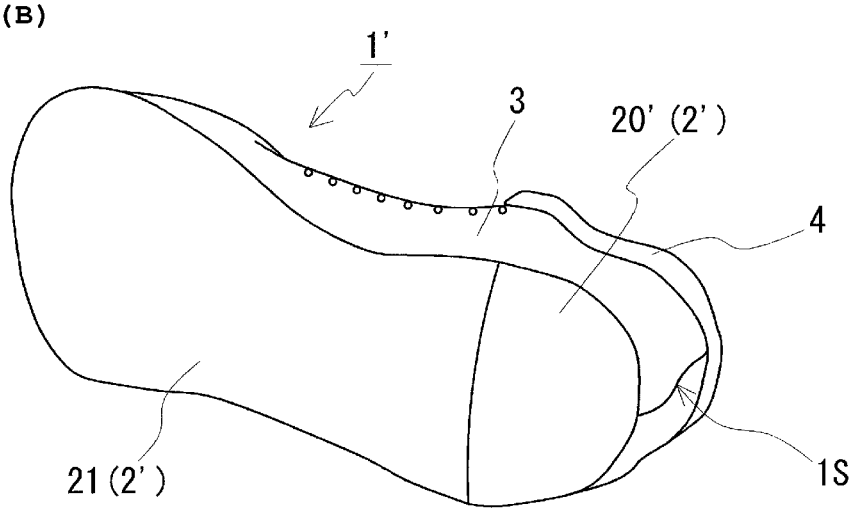
Figure 4:
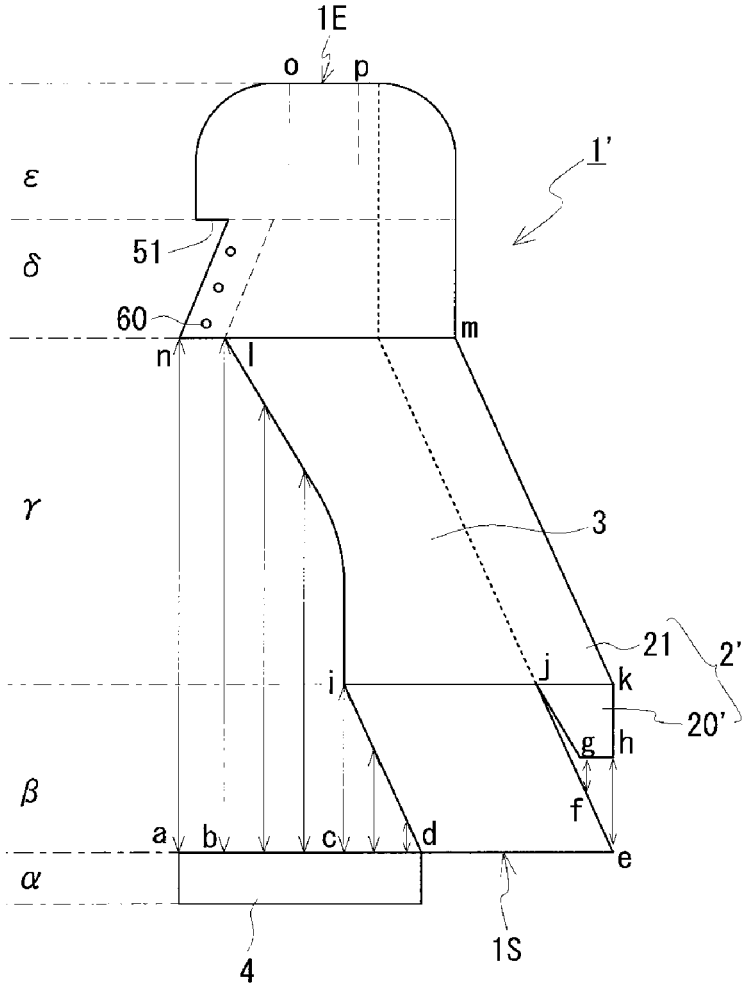
FIG. 4(A) is a knitting step image diagram schematically showing knitting steps of the footwear of the second embodiment.
FIG. 4(B) is a bottom view of the footwear knitted according to the knitting step image of FIG. 4(A)
FIG. 4(C) is a partial bottom view of a variant of the footwear knitted according to the knitting step image of FIG. 4(A)
Figure 4:
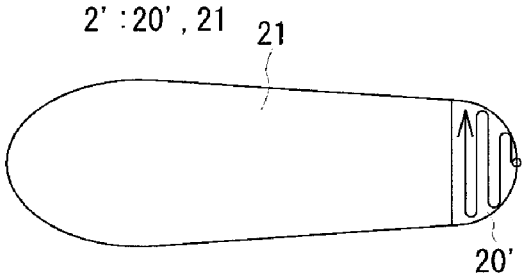
Figure 4:
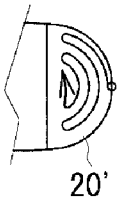

In a second embodiment, the knitting method different from the first embodiment will be described based on FIGS. 3 and 4. The difference between the embodiments lies only in the configuration of the heel portion and the method for knitting the heel portion, and hence such difference will be mainly described in the present embodiment.

As shown in FIG. 3(A), a shoe upper 1' of the second embodiment does not differ in outer appearance from the shoe upper 1 of the first embodiment when seen from the insert opening 40 side. However, as shown in FIG. 3(B), when the shoe upper 1' is seen from a sole cover section 2' side, the setup portion 1S is formed from the upper end to the lower end of the instep cover section 3 but is not extended to the sole cover section 2'. Furthermore, in the second embodiment, the whole of the heel portion 20' formed on the heel side of the sole cover section 2' is formed by the flechage knitting of gradually widening the knitting width or the flechage knitting of gradually narrowing the knitting width.

The shoe upper 1' including the heel portion 20' can be knitted according to a knitting step image diagram of FIG. 4(A). The manner of viewing FIG. 4(A) is the same as FIG. 2(A). Alphabets a to p are denoted to the key points in the knitting of FIG. 4(A).

[Knitting of Regions α to β]

First, the insert section 4 is knitted, similar to the first embodiment. Then, the setup portion 1S is formed on the knitting needle on which the stitches of the insert section 4 are not held (see line d-e). The forming width of the setup portion 1S is the same as the height of a heel side end of the shoe upper 1' shown in FIG. 3.

Then, the stitch row to become the side surface of the instep cover section 3 is knitted following the wale direction of the setup portion 1S, and the knitted stitch row is transferred to the left side in the plane of drawing to join the line d-i of the instep cover section 3 to the line d-c of the insert section 4. At the time point the region d-e-j-i of the instep cover section 3 is completed, the stitches of the a-b-c(i)-j-f-e are held on the needle bed. The knitting of the heel portion 20' is started following the wale direction of the line f-e of the instep cover section 3. The line f-e of the instep cover section 3 and the line g-h of the heel portion 20' are thereby joined. The line g-j of the heel portion 20' is connected to the line f-j of the instep cover section 3 while increasing the stitch row of the heel portion 20'. The knitting of the region d-e-j-i of the instep cover section 3 and the knitting of the region g-h-k-j of the heel portion 20' may be carried out in parallel.

In the knitting shown in FIG. 4(A), the heel portion 20' is knitted by the flechage knitting of gradually widening the knitting width. The flechage knitting is carried out in continuation on the right side portion (g-h-k-j) and the left side portion (portion hidden on the far side) of the heel portion 20'. According to such knitting, the knitting width is gradually widened so that the heel portion 20' in which the curved shape is formed on the heel side of the sole cover section 2' is formed, as shown in FIG. 4(B). The right side portion (g-h-k-j) of the heel portion 20' and the left side portion (portion hidden on the far side) may, of course, be knitted separately, in which case, the right side portion and the left side portion are connected at the line h-k.

As shown in FIG. 4(C), the heel portion 20' may be knitted by gradually narrowing the knitting width. In this case, for example, in FIG. 4(A), after knitting the portion surrounded by the d-e-j-i of the instep cover section 3, the knitting of the heel portion 20' may be started following the wale direction of the line j-f-e.

[Knitting of Regions γ to ϵ]

After the knitting of the heel region β is finished, the instep cover section 3 and the sole main body portion 21 are knitted in continuation to the wale direction of the line i-j of the instep cover section 3 and the line j-k of the heel portion 20' to complete the main body back part region γ. The main body back part region δ and the toe region ϵ are then knitted, and the line o-p is closed with the knitting end portion 1E. The knitting procedure of the regions γ, δ, ϵ is exactly the same as that of the first embodiment.

Third Embodiment

Figure 5:
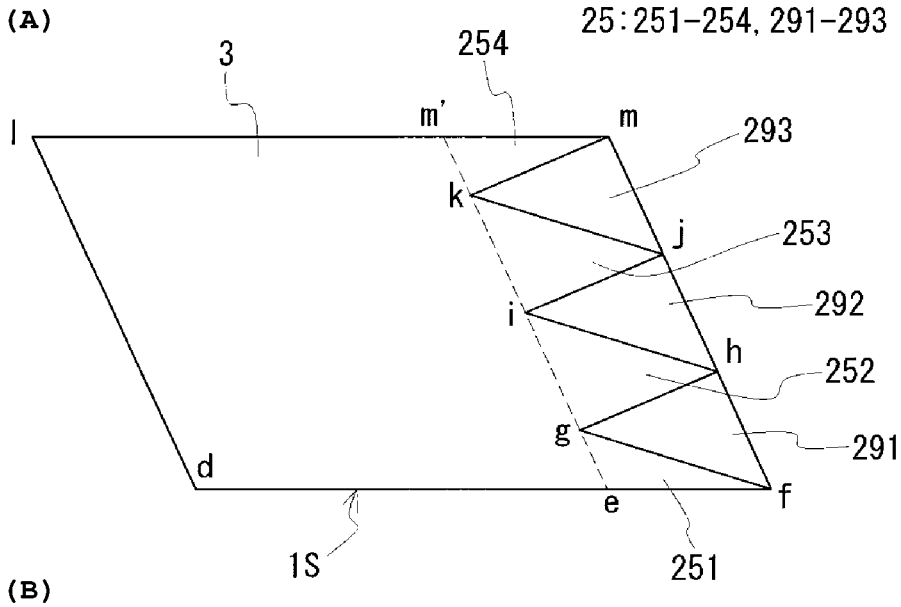
FIG. 5(A) is a knitting step image diagram schematically showing knitting steps of a heel portion of a footwear of a third embodiment.
FIG. 5(B) is an explanatory view of a method for knitting the heel portion.
FIG. 5(C) is a bottom enlarged view of the heel portion knitted according to the knitting step image of FIG. 5(A)
Figure 5:
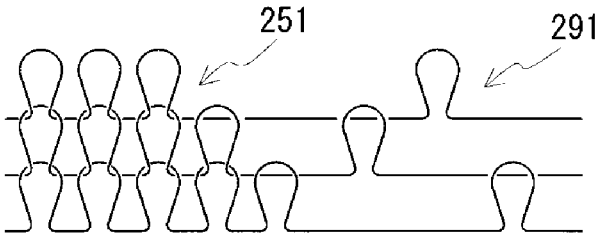
Figure 5:
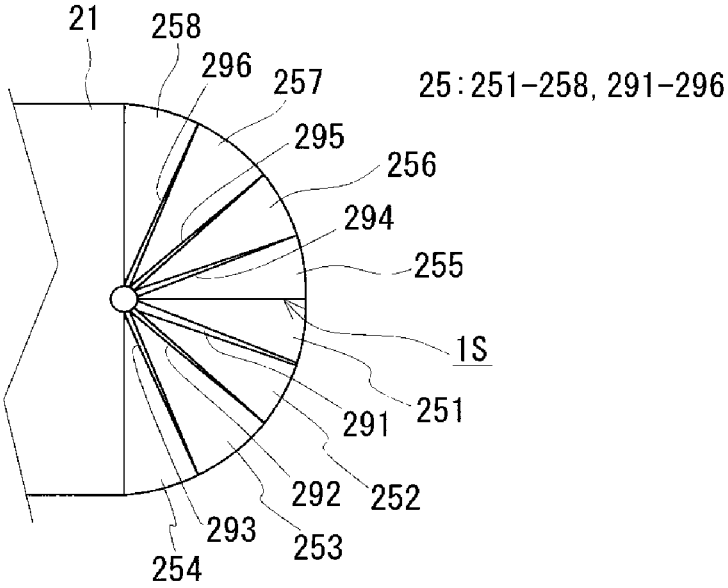

In a third embodiment, the knitting method different from the first and second embodiments will be described based on FIG. 5. The knitting method of the third embodiment differs from the first embodiment only in the method for knitting a heel portion 25. Therefore, only such difference will be described.

As shown in FIG. 5(C), the setup portion 1S of a shoe upper (not shown) of the third embodiment is extended to a boundary of the heel portion 25 and the sole main body portion 21 in the sole cover section 2. This is the same as the configuration of the first embodiment.

As shown in FIG. 5(C), the heel portion 25 is formed by a plurality of fan-shaped pieces 251 to 258 lined in the arc shape with the setup portion 1S in between, and interposing pieces 291 to 296 arranged between the adjacent fan-shaped pieces 251 to 258. A special knitting for forming a portion where the density of the stitches is high and a portion where the density of the stitches is low in the knitting width direction is necessary in order to knit such heel portion 25.

FIG. 5(A) is a knitting step image diagram of the heel portion 25. The portion surrounded by e-f-g, g-h-i, i-j-k, k-m-m' of FIG. 5(A) is the portion that becomes the fan-shaped pieces 251 to 254, and is the portion where the density of the stitches is high. The portion surrounded by f-g-h, h-i-j, j-k-m, on the other hand, is the portion that becomes the interposing pieces 291 to 293, and is the portion where the density of the stitches is low.

The special knitting mentioned above will be described based on FIG. 5(B). First, in the portion of the e-f-g of FIG. 5(A), the knitting is carried out with the space between the stitches made close as shown in FIG. 5(B), and the number of stitches in the knitting width direction is reduced each time the number of tiers of the stitch row is increased. The fan-shaped piece 251 is thereby formed. On the other hand, in the portion of the f-g-h of FIG. 5(A), the stitches are formed only on the knitting needles of every two to five needles, and furthermore, the position of the stitch in the knitting width direction is changed each time the tier of the stitch row is changed. At the portion where the density of the stitches is low like this, the stitches of the stitch rows of different tiers are aligned on a substantially straight line, and such portion becomes the interposing piece 291 of an elongated triangular-like shape as shown in FIG. 5(C) in which a tapered distal end is directed in a direction opposite to the fan-shaped piece 251. Other portions of FIG. 5(A) are similarly formed, and as a result, the heel portion 25 as shown in FIG. 5(C) is formed.

Fourth Embodiment

In the first to third embodiments, the knitting is started from the insert section, and the shoe upper is knitted from the heel region β toward the toe region ϵ. On the other hand, the insert section may be knitted after knitting the shoe upper from the toe region ϵ toward the heel region β. For example, in the case of the shoe upper 1 of the first embodiment referencing FIG. 1, the shoe upper 1 may be knitted through the knitting procedure in which the knitting procedure of FIG. 2(A) is made substantially upside down. This will be specifically described below.

First, the setup portion (see q-r in FIG. 2) is formed on the needle bed, and the toe region ϵ is knitted following the setup portion. Next, the bind-off process is performed on the portion to become the cut end 51 of the terminating end in the wale direction of the toe region ϵ, and the main body front part region δ following the other portion is knitted. The knitting of the stitch row of the main body back part region γ following the n-o of the main body front part region δ and the moving of the knitted stitch rows toward the right side in the plane of drawing are repeated. In the knitting of the main body back part region γ, when knitting a new stitch row following the stitch rows moved toward the right side in the plane of drawing, a pickup stitch is formed at the end in the knitting width direction of the stitch row. The pickup stitches corresponding to the line of n-l of the main body back part region γ are thus lined on the needle bed, and the stitch row can be formed following the line of n-l. The line of n-l can be curved by appropriately increasing/reducing the knitting width in the knitting of the main body back part region γ. The curved line is formed to prevent the instep cover section 3 from interfering with the ankle of the wearer, similar to the first embodiment.

Furthermore, the heel region β following the stitches (stitches of l-m) at the end in the wale direction of the main body back part region γ is knitted. With respect to the heel region β as well, the knitting of the stitch row of the heel region β and the moving of the knitted stitch row toward the right side in the plane of drawing are repeated. In this case, the fan-shaped pieces 204, 203, 202, and 201 are sequentially formed, and the instep cover section 3 and the sole cover section 2 are completed.

After the knitting of the instep cover section 3 and the sole cover section 2 is finished, the stitches of the p-n-l-d-e-f are held on one needle bed, and hence the stitches of the d-e-f are joined with the left side portion of the shoe upper 1 on the back side in the plane of drawing to form the knitting end portion. The insert section 4 is then knitted following the wale direction of the stitches of the p-n-l-d of the instep cover section 3 to complete the shoe upper 1. The direction of the stitches in the shoe upper 1 of the first embodiment is directed to exactly the opposite to the shoe upper 1 of the first embodiment.

Fifth Embodiment

In the first to fourth embodiments, the setup portion 1S (knitting end portion in the fourth embodiment) is formed at the heel side end, and the knitting end portion 1E (setup portion in the fourth embodiment) is formed at the toe side end. However, although the setup portion 1S (knitting end portion) needs to be formed at the heel side end in order to form the heel portion 20, 20', 25, the knitting end portion (setup portion) does not need to be formed at the toe side end. One example of a knitting procedure in which the knitting end portion (setup portion) is not formed at the toe side end is shown in FIG. 6.

Figure 6:
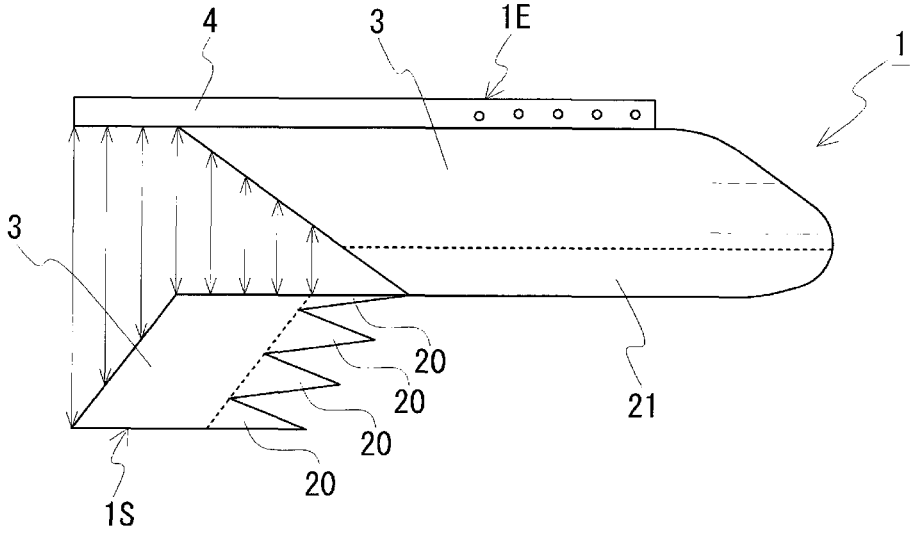
FIG. 6 is a knitting image diagram schematically showing knitting steps of a footwear of a fifth embodiment.

In the knitting procedure of FIG. 6, the setup portion 1S to become the heel side end of the shoe upper 1 is first knitted, and the heel portion 20 and the heel side portion of the instep cover section 3 are knitted following the setup portion 1S. Then, the sole main body portion 21, the toe side portion of the instep cover section 3, and the insert section 4 are sequentially knitted with the C-shaped knitting. The knitting end portion 1E is formed at an eyelet forming portion of the instep cover section 3 and an upper end of the insert section 4 by the bind-off process to complete the shoe upper 1. The shoe upper 1 can be, of course, completed with a procedure inversed from the knitting order described above.

Sixth Embodiment

In the first to fifth embodiments, the shoe upper of a shoelace type with a shoelace has been described, but a shoe upper of a step-in type without a shoelace may be realized. In this case, the insert section 4 is formed to a tubular shape, and the slit 50 extending from the insert section 4 to the toe is not formed when knitting the instep cover section 3.

In addition, the insert section 4 may not be knitted when knitting the shoe upper 1. In this case, after completing the shoe upper 1 without the insert section 4, a reinforcement material made from resin and the like is preferably attached to the edge portion of the insert opening 40, or the insert section 4 knitted separate from the shoe upper 1 is preferably joined.

Seventh Embodiment

Figure 7:
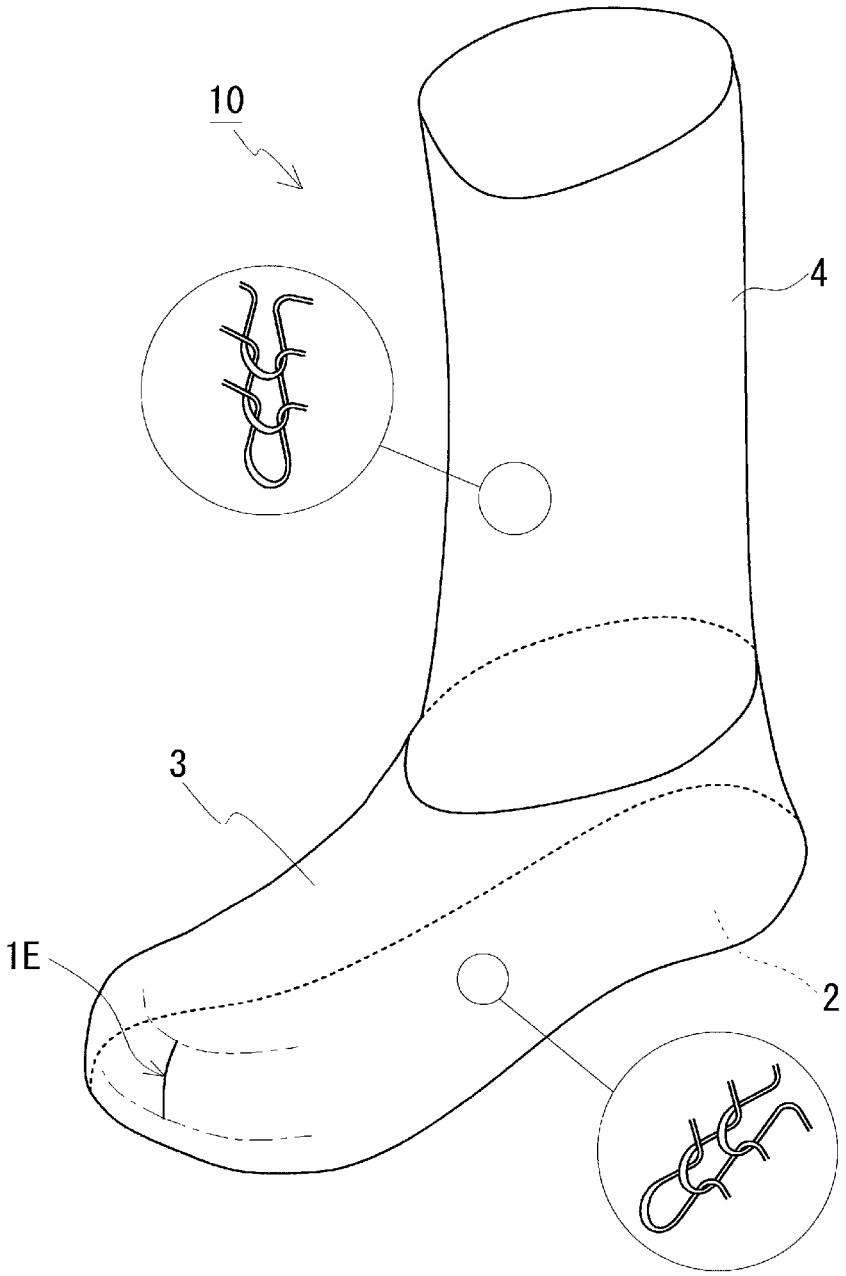
FIG. 7 is a schematic perspective view of a sock shown in a seventh embodiment.

A sock 10 illustrated in FIG. 7 can be knitted using the knitting similar to the first to sixth embodiments. When knitting such a sock 10, for example, the insert section 4 may be tubular knitted in FIG. 2(A). In this case, crew socks, high socks, knee socks, and the like can be produced by adjusting the length in the wale direction of the insert section 4. The toe side of the sock 10 is not limited to the closing method illustrated in FIG. 7. For example, a plurality of finger tubes may be formed on the toe side of the sock 10, and the tip of each finger tube may be closed to knit a five-toe-sock, and the like.

REFERENCE MARKS IN THE DRAWINGS

1, 1' footwear (shoe upper)
- 1S setup portion
- 1E knitting end portion

2, 2' sole cover section
- 20, 20', 25 heel portion
  - 201~208 fan-shaped piece
  - 251~258 fan-shaped piece
  - 291~296 interposing piece
- 21 sole main body portion

3 instep cover section
4 insert section
- 40 insert opening
- 50 slit
- 51 cut end
- 60 eyelet hole

10 sock (footwear)

The invention claimed is:

1. A footwear including an instep cover section for covering an instep side portion of a wearer, and a sole cover section for covering a sole of the wearer; wherein the instep cover section and the sole cover section are integrally knitted in a seamless manner with a knitting pattern, by starting at a setup portion at a heel side end of the footwear and ending at a knitting end portion located at a position other than the heel side end, or by starting at a setup portion at a position other than the heel side end and ending at a knitting end portion located at a position of the heel side end;

wherein a portion of a predetermined range for covering a back end of a heel of the wearer is assumed as a heel portion and the other portion is assumed as a sole main body portion, in the sole cover portion, said setup portion or knitting end portion formed at the heel side end is extended in a height direction of the footwear and also connected to the heel portion; and the heel portion is formed by knitting stacking course rows in plural tiers in a wale direction and gradually differing the number of stitches in a knitting width direction of the course row when stacking the tiers of the course row, the heel portion being formed to a tongue shape in which a width gradually becomes narrower toward a heel side of the footwear according to the change in the number of stitches.

2. The footwear according to claim 1, wherein the setup portion or the knitting end portion formed at the heel side end of the footwear is arranged from an upper end to a lower end of the instep cover section and extended to the sole cover section up to a boundary of the heel portion and the sole main body portion; and the heel portion is formed by a plurality of fan-shaped pieces lined in an arc shape with the setup portion or the knitting end portion in the sole cover section in between.

3. The footwear according to claim 1, wherein the setup portion or the knitting end portion formed at the heel side end of the footwear is arranged from an upper end to a lower end of the instep cover section; and the whole of the heel portion is formed by a flechage knitting of gradually widening a knitting width, or by a flechage knitting of gradually narrowing the knitting width each time the number of tiers in a wale direction of the stitch row configuring the heel portion is increased.

4. The footwear according to claim 1, wherein the setup portion or the knitting end portion formed at the heel side end of the footwear is arranged from an upper end to a lower end of the instep cover section and extended to the sole cover section up to a boundary of the heel portion and the sole main body portion; and the heel portion is formed by a plurality of fan-shaped pieces lined in an arc shape with the setup portion or the knitting end portion in the sole cover section in between and an interposing piece arranged between the adjacent fan-shaped pieces.

5. The footwear according to claim 1, wherein the footwear is a shoe upper knitted using a thermoplastic yarn.

6. A method for knitting a footwear including an instep cover section for covering an instep side portion of a wearer and a sole cover section for covering a sole of the wearer, wherein assuming a region of a predetermined range for covering a back end of a heel of the wearer as a heel portion and the other portion as a sole main body portion, in the sole cover section, the footwear is knitted according to following procedure [1] or [2] using a flat knitting machine including at least a pair of a front and a back needle bed and in which stitches formed on each needle bed are transferrable; and in the knitting of the heel portion, differing the number of stitches in a knitting width direction of a course row of each tier when stacking the course row in plural tiers in a wale direction is carried out;

[1]

knitting a setup portion, knitting a heel side portion of a left side surface and a right side surface of the instep cover section and a heel portion of the sole cover section based on the setup portion; and knitting a sole main body portion of the sole cover section and a toe side portion of the instep cover section to complete the footwear;

[2]

knitting a setup portion, knitting a toe side portion of the instep cover section and the sole main body portion based on the setup portion; and knitting a heel portion of the sole cover section and a heel side portion of the instep cover section toward the heel side of the footwear, and closing a left side surface and a right side surface of the footwear at a heel side end of the footwear to complete the footwear.

* * * * *